US005381949A

United States Patent [19]

Correll

[11] Patent Number: 5,381,949

[45] Date of Patent: Jan. 17, 1995

[54] BOX

[76] Inventor: John D. Correll, 8459 Holly Dr., Canton, Mich. 48187

[21] Appl. No.: 69,830

[22] Filed: Jun. 1, 1993

[51] Int. Cl.[6] ..... B65D 5/30

[52] U.S. Cl. ..... 229/198.2; 229/148; 229/195; 229/935; 229/936

[58] Field of Search ..... 229/148, 152, 154, 165, 229/195, 198.2, 933, 935, 936

[56] References Cited

U.S. PATENT DOCUMENTS

| | | | |
|---|---|---|---|
| 279,199 | 6/1883 | Stevens | 229/198.2 |
| 504,824 | 9/1893 | Cook | 229/154 |
| 1,530,644 | 3/1925 | Blandford . | |
| 2,072,753 | 3/1937 | Ikeda et al. | 229/148 |
| 2,425,283 | 2/1948 | Lighter . | |
| 2,429,540 | 10/1947 | Woodruff . | |
| 2,756,919 | 7/1956 | Davidson | 229/936 |
| 2,789,750 | 4/1957 | Kramer . | |
| 3,003,674 | 10/1961 | Ringler | 229/152 |
| 3,086,691 | 4/1963 | Fobiano | 229/195 |
| 3,105,626 | 10/1963 | McCormick et al. | 229/148 |
| 3,371,842 | 3/1968 | Hechtmann et al. . | |
| 3,497,127 | 2/1970 | Box | 229/198.2 |
| 3,572,576 | 3/1971 | Foster | 229/936 |
| 3,744,705 | 7/1973 | Kuhn et al. | 229/148 |
| 4,053,099 | 10/1977 | Lock . | |
| 4,332,577 | 6/1982 | Mosse . | |
| 4,471,902 | 9/1984 | Skaggs | 229/148 |
| 4,494,689 | 1/1985 | Ilitch | 229/165 |
| 4,516,718 | 5/1988 | Forbes, Jr. | 229/148 |
| 4,567,341 | 1/1986 | Brown . | |
| 4,655,386 | 4/1987 | Billberg . | |
| 4,804,136 | 2/1989 | Hall . | |
| 5,118,033 | 6/1992 | Kula . | |
| 5,226,587 | 7/1993 | Eisman et al. | 229/148 |

FOREIGN PATENT DOCUMENTS

| | | | |
|---|---|---|---|
| 2560152 | 8/1985 | France | 229/198.2 |
| 2312859 | 9/1974 | Germany | 229/148 |
| 591369 | 9/1977 | Switzerland . | |

*Primary Examiner*—Gary E. Elkins

*Attorney, Agent, or Firm*—Reising, Ethington, Barnard, Perry & Milton

[57] ABSTRACT

A one-piece box is disclosed which is foldable from a flat blank to an erect box. The box is provided with a corner interlock comprising a tab on the side wall extending through an opening in the front wall. A cover interlock is provided using a single panel front wall having a tab which extends through an opening in the cover. The box blanks may be cut from a single board in side-by-side nested relationship with a wall or flap of one box blank being of reduced height and receiving a protruding portion of the corresponding wall or flap of the adjacent box blank.

20 Claims, 4 Drawing Sheets

FIG-3
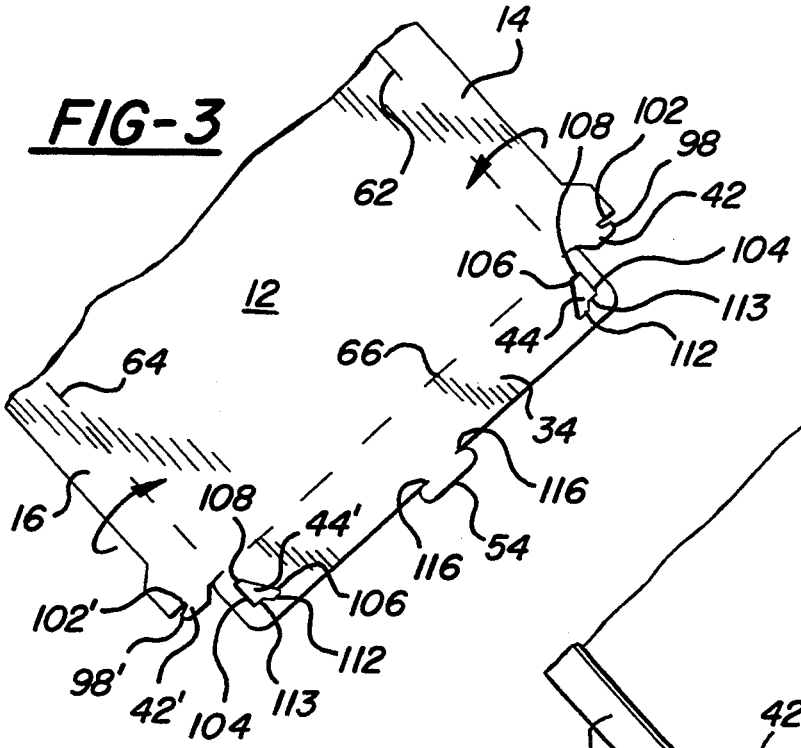
FIG-4
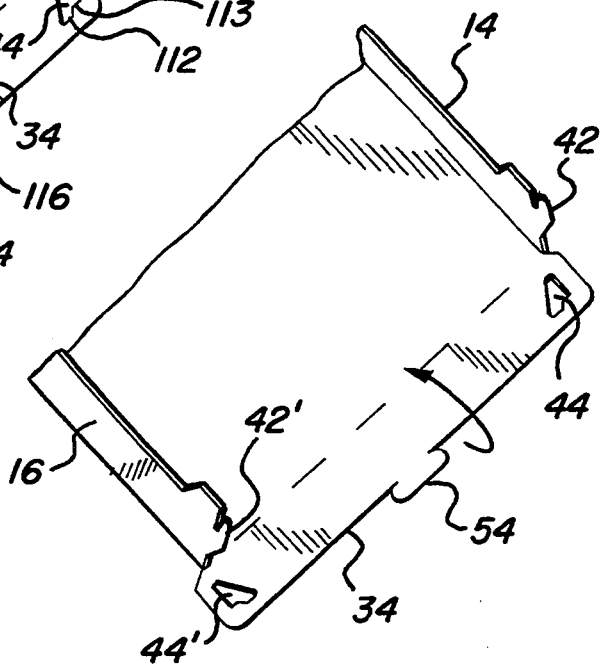
FIG-5
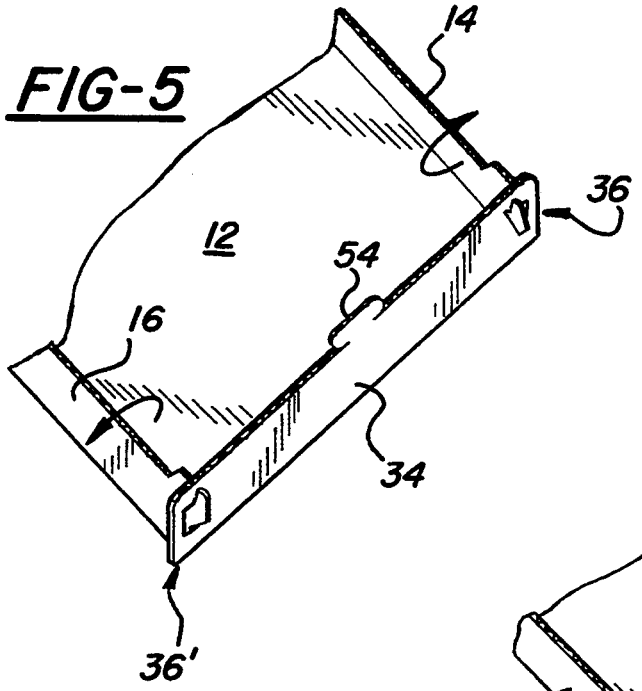
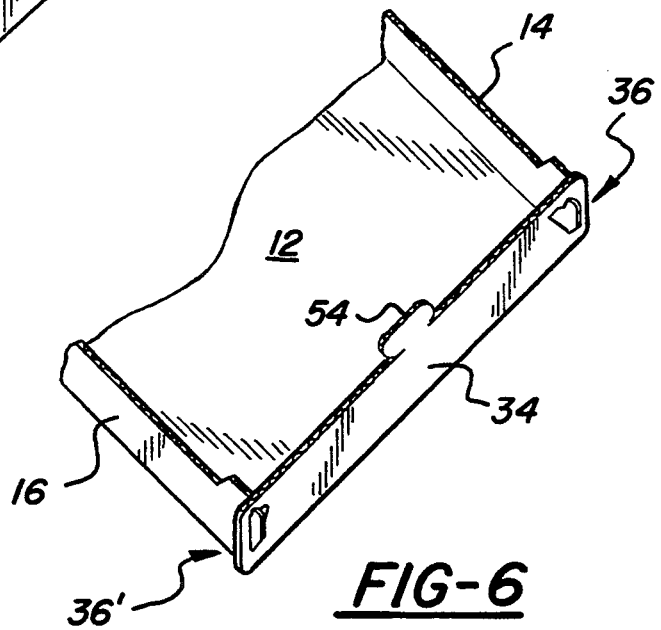
FIG-6

BOX

FIELD OF THE INVENTION

This invention relates to boxes; more particularly, it relates to boxes which are especially adapted for pizza and other food.

In the pizza retail industry, the cost of the box for delivery and carry-out pizza amounts to a substantial percentage of the total cost of the product. Pizza retailers and box manufacturers have for a long time sought to find ways to reduce the cost of pizza packaging. To that end, they have pursued changes in the thickness, color and the composition of the corrugated board used in box fabrication. Such changes in material have provided only minor savings. In the prior art, there have been various proposed box designs which would require less board material with a resulting savings in cost. However, the prior art box designs which would provide a significant reduction in the cost of the box have attendant shortcomings in box performance.

Despite the great amount of effort expended in reducing the cost of pizza boxes there has remained a need for a lower cost box which will satisfy the performance standards required by the pizza industry.

A pizza box which will satisfy the needs of the pizza industry should provide, in addition to cost savings, certain performance capabilities. Cost savings in the manufacture of the box itself may be realized by the reduction in the amount of corrugated board and still provide proper packaging and protection of the product. Reduction of the material usage also reduces the waste of natural resources and the resulting impact of waste disposal on the environment.

In order to properly package a product, such as pizza, the box must exhibit a high degree of rigidity and strength. The box should be sufficiently rigid so that it will not droop when it is held at any corner with one hand. Such handling should not result in accidental opening of the cover. Weak spots in the box structure, such as slots along the front edge of the bottom of the box, must be eliminated to prevent bending of the bottom when the box is held by the front corner with one hand. Such slots are also undesirable because they allow fluids that seep from the pizza to flow from the box onto clothing and car seats.

The box design must lend itself to fast box set-up time, i.e. The time required for folding a flat box blank into an erect box structure ready for receiving the product. The boxes currently used by the pizza industry typically require about ten seconds set-up time per box. For a typical pizza store, which uses about one thousand boxes per week, this box set-up time requires about three labor hours.

With the current pizza box designs, the box makers must manufacture and inventory two styles of box. A box of connected-wall design is used by pizzerias which cut the product outside the box and slide it into the box after it is cut. A box of unconnected-wall design is used by pizzerias which cut the pizza in the box with the cover open and the walls laid flat. There is a need for a pizza box which can be used by pizzerias that do the cutting in the box as well as those that do the cutting outside. With this, cost savings would be realized in eliminating the need for two kinds of production dies and the need for inventory of two kinds of box blanks with the cost advantage of longer production runs of the same box.

In the prior art there are several examples of pizza boxes which are designed to either save box material or to provide improved structural features.

The following patents disclose box designs for one-piece boxes which are made from flat box blanks by folding along predetermined fold lines, the box blanks having a configuration which permits die cutting of side-by-side nested blanks from rectangular sheet material. The Lighter patent 2,435,283 granted Feb. 3, 1948 discloses a box blank configuration which may be cut from board material with adjacent box blanks in inverted and nested relation and having the ends of the blanks in alignment with each other. The configuration of this blank provides side walls and cover flaps which are of different height and of uniform height throughout their length. A similar box blank design is shown in the Woodruff patent 2,429,540 granted Oct. 21, 1947. Other box designs which have a box blank configuration which can be nested are described in the Billberg patent 4,655,386 granted Apr. 7, 1987 and the Mosse patent 4,332,577 granted Jun. 1, 1982.

Box designs with integral interlock tabs for locking the box cover to a wall of the box are disclosed in the Blandford patent 1,530,644 granted Mar. 24, 1925; the Lock patent 4,053,099 granted Oct. 11, 1977; the Hall patent 4,804,136 granted Feb. 14, 1989; and the Kula patent 5,118,033 granted Jun. 2, 1992.

Various box structures are known in the prior art with a connection or interlock at a corner formed by adjacent walls. Such prior art structures provide wall portions which wrap around the corner as described in the Kramer patent 2,789,750 granted Apr. 23, 1957; the Hechtmann et al. patent 3,371,842 granted Mar. 5, 1968; and the Brown patent 4,567,341 granted Jan. 28, 1986.

A general object of this invention is to provide an improved box which is erected from a flat box blank by folding and which overcomes certain structural and operational disadvantages of the prior art.

SUMMARY OF THE INVENTION

In accordance with this invention, a box is provided which requires a minimized amount of material in the box structure with a minimized amount of waste and yet which provides structural integrity with a high degree of rigidity. This is realized by a design which allows for cutting box blanks from a board in side-by-side nested relationship with a wall or flap portion of one box blank being of reduced height in all or part of its length and receiving a protruding portion of the corresponding wall or flap of the adjacent box blank.

Further, in accordance with this invention, a corner interlock is provided for the front corners of a box which allows a single panel front wall without the need for slots in the bottom. Quick set-up and take-down of the box is provided along with structural integrity and a high degree of rigidity. The invention also allows for the same box being used for cutting pizza inside the box or outside the box because it is adapted for quick setup and take-down. This is realized by a corner interlock comprising a tab and opening arrangement.

Further, in accordance with this invention, an interlock structure is provided for securing the cover to the front wall of the box using a single panel front wall without the need for a front cover flap while providing the box integrity with a high degree of rigidity. This is achieved by a unique tab and opening arrangement.

A complete understanding of this invention may be obtained from the detailed description that follows taken with the accompanying drawings.

DESCRIPTION OF THE DRAWINGS

FIG. 3 is a fragmentary view of the box showing the initial step of erecting the box;

FIG. 4 is a fragmentary view showing an intermediate step of erecting the box;

FIG. 5 is a fragmentary view showing a further intermediate step with the front corner interlock partially engaged;

FIG. 6 is a fragmentary view showing the front corner interlock fully engaged;

BEST MODE FOR CARRYING OUT THE INVENTION

Figure 1:
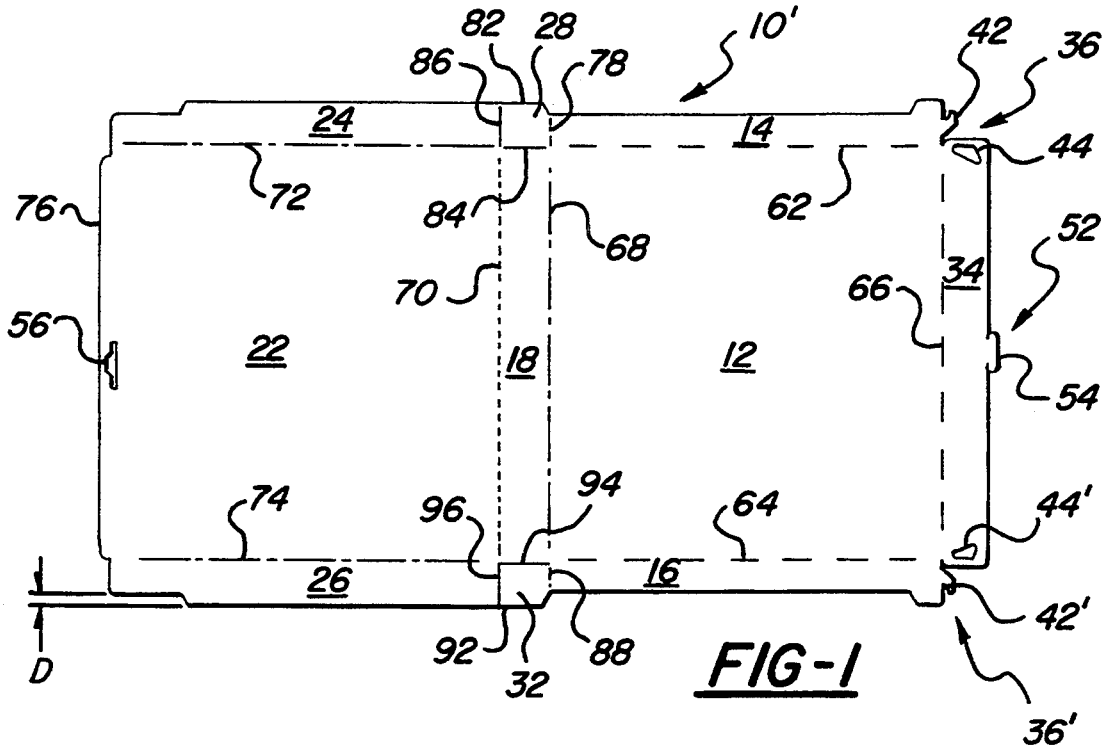
FIG. 1 is a plan view of the box blank for making the box of the invention.

Referring now to the drawings, there is shown an illustrative embodiment of the invention in a one-piece pizza box made of fibreboard. It will be appreciated, as the description proceeds, that the invention may be realized in different embodiments and may be used in other applications.

Figure 2:
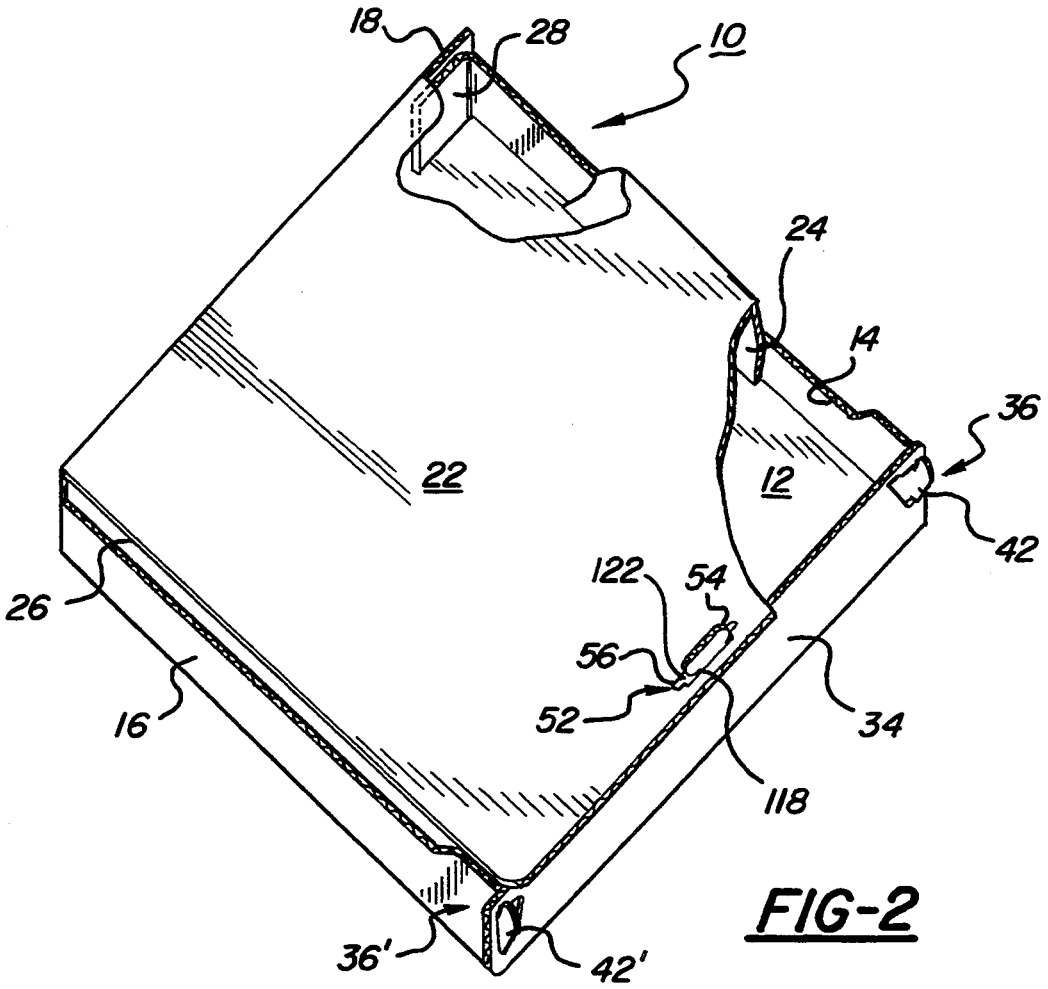
FIG. 2 is a perspective view of the box with parts partially cut away.
Figure 8:
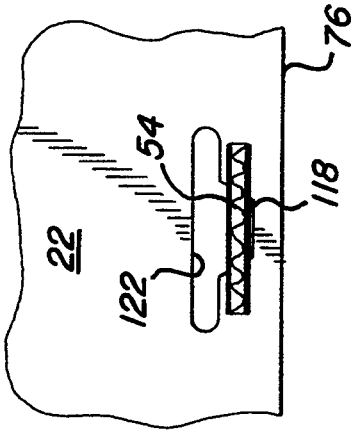
FIG. 8 is a fragmentary view of the cover showing the cover interlock fully engaged.
Figure 7:
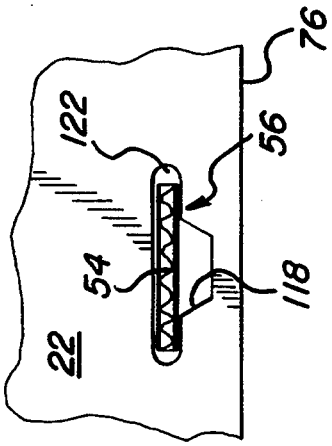
FIG. 7 is a fragmentary view of the cover showing the cover interlock in an initial stage of engagement.

The box 10 of this invention, as shown in FIG. 2, is constructed from a box blank 10' which is shown in FIG. 1. The box 10, in general, comprises a bottom panel 12 of rectangular shape and a pair of unitary side walls 14 and 16 disposed on opposite sides of the bottom panel 12. The bottom panel 12 terminates at its rear edge in a unitary rear wall 18 which terminates at its upper edge in a cover 22 of rectangular shape. The cover 22 carries the pair of unitary cover flaps 24 and 26 on opposite sides. The side walls 14 and 16 carry a pair of unitary rear corner flaps 28 and 32, respectively. A front wall 34 is unitary with the bottom panel 12 and it is interlocked with the side wall 14 and side wall 16 by interlocks 36 and 36', respectively. The interlock 36 comprises, in general, a tab 42 on the front edge of side wall 14 and a shaped opening 44 in the right end of the front wall 34. The interlock 36' in general, comprises a tab 42' on the front end of side wall 16 and a shaped opening 44' in the left end of the front wall 34. The cover 22 is secured to the front wall 34 by a cover interlock 52 which, in general, comprises a tab 54 on the top edge of front wall 34 and a shaped opening 56 near the front edge of the cover 22.

The box blank 10' is cut from a flat sheet of fibreboard material preferably corrugated board. In the illustration of the box blank 10' of FIG. 1, an interrupted line with long dashes represents a fold line created by spaced slits through the board. An interrupted line of short dashes represents the fold line formed by closely spaced short slits. An interrupted line comprising alternate dots and dashes represents a fold line formed by a continuous indentation or impression of the board. A solid line represents a separation of the board formed by a slit through the board. Any method of forming a fold line in the box material is herein referred to as scoring of the board. The methods of forming the fold lines as described herein are presently preferred but it will be appreciated that any one of the methods may be used to form any of the fold lines and other methods known to those skilled in the art may be used for any of the fold lines. Fibreboard and other box materials which exhibit the capability of "springing back" from a folded position along a fold line are preferred for use with this invention.

Referring again to FIG. 1, the box blank 10' will be described in further detail. The bottom panel 12 has a right edge defined by a fold line 62 and has a left edge defined by a fold line 64. It has a front edge defined by a fold line 66 and a rear edge defined by a fold line 68. The side walls 14 and 16 are hingedly attached to the bottom panel 12 by the fold line 62 and 64 and the front wall 34 and rear wall 18 are hingedly attached to the bottom panel 12 by the hinge lines 66 and 68, respectively. The cover 22 is defined at its rear edge by a fold line 70 and on its right side and left side by fold lines 72 and 74, respectively. The right cover flap 24 is hingedly attached to the cover 22 by the fold line 72 and the left side cover flap 26 is hingedly attached by fold line 74 to the cover 22. The front edge 76 of the cover 22 is unattached and hence a free edge.

Each of the cover flaps 24 and 26 has a height throughout a greater part of its length which is substantially the same as the height of the rear wall 18. Each of the flaps has a height throughout a lesser part of its length which is less than that of the rear wall 18 by an offset distance D as shown in FIG. 1. As will be described subsequently, when the box is erected, as shown in FIG. 2, the side flaps 24 and 26 are tucked inside the side walls 14 and 16, respectively. Thus, the flaps 24 and 26 are seated on the bottom 12 and this structure imparts rigidity to the box such that the cover is supported by the side flaps 24 and 26 and also by the rear wall 18 and the front wall 34. Each of the side walls 14 and 16 has a height, throughout a greater part of its length, which is less than that of the rear wall 18 by the offset distance D. Each of the side walls has a height at its front end and extending throughout a lesser part of its length which is substantially the same as the height of the rear wall. As will be discussed subsequently, this relationship between the heights of the side walls 14 and 16 and the side flaps 24 and 26, provides a substantial savings in box material by allowing box blanks to be cut from a single piece of board with the blanks oriented one hundred eighty degrees with each other and in nested relationship to reduce waste of the board.

The corner flap 28 is defined at its front edge by a fold line 78 and by upper free edge 82, lower free edge 84 and inner free edge 86. Thus, the corner flap 28 is hingedly attached along the fold line 78 to the side wall 14. Similarly, the left hinge flap 32 is defined by fold line 88 at the rear of side wall 16. It is further defined by upper free edge 92, lower free edge 94 and inner free edge 96. Thus, the corner flap 32 is hingedly connected along the fold line 88 to the side wall 16.

The front corner interlocks 36 and 36' will now be described in more detail with particular reference to FIGS. 1, 2 and 3. The right corner interlock 36 comprises the tab 42 on the front edge of the side wall 14 and the shaped opening 44 on the right end of the front wall 34. The tab 42, suitably lobe-shaped, is an extension of the side wall 14 and is provided with a hook portion 98 (see FIG. 3) at its upper edge. The hook portion 98 of the tab and the front edge of the side wall 14 define a notch 102. The notch 102 is V-shaped and has a width at its bottom which is substantially equal to or less than the thickness of the front wall 34. The shaped opening 44 is suitably configured with a straight outer edge 104 parallel to the fold line 62 and a diagonal inner edge 106 which extends obliquely at about twenty to thirty degrees of the outer edge 104. The edges 104 and 106 are joined by a bottom edge 108 and a top edge 112. The bottom edge is suitably straight and parallel to the fold line 66. The top edge is of special configuration so as to provide an opening adjacent the inner edge 106 which is large enough to allow the tab 42 to enter the opening 44 without interference with the side wall held in a folded position approximately in line with the inner edge 106 while the front wall is folded to a position perpendicular to the bottom panel 12. The top edge 112 of opening 44 is further configured to provide a shoulder portion 113 which provides an interlock with the tab 42 in a manner to be described subsequently. It will be appreciated that the opening 44 may be of other shapes such as rectangular or round and meet the functional requirements described. The corner interlock 36' is of the same construction as the right corner interlock 36 and the corresponding parts are referred to by the same reference numbers with a prime symbol.

The cover interlock 52 will be described in detail with reference to FIGS. 1, 2, 3, 7 and 8. It comprises the tab 54 extending upwardly from the upper edge of the front wall 34 and a shaped opening 56 in the front portion of the cover 22. The tab 54 is lobe-shaped with a pair of notches 116 (see FIG. 3) on each side defined by the tab and the upper edge of the front wall 34. The tab 54 is suitably but not necessarily symmetrical about a center line extending perpendicularly to the fold line 66. It is preferably centered on the front wall 34. The shaped opening 56 is also suitably but not necessarily symmetrical about a center line extending perpendicularly to the fold line 70 and it is positioned on the cover 22 so that the center lines of the opening 56 intersects the center line of the tab 54. The opening 56 is formed with a narrow portion 118 which is in alignment with the front wall 34 and which is narrower than the lobe of the tab 54 so that the tab cannot pass through the narrow portion 118 without interference. The opening 56 includes a wider portion 122 adjacent the rear of the narrow portion 118. The wider portion 122 is large enough to allow the tab 54 to pass therethrough without interference when properly aligned with it and the notches 116 allow an interlock to be made between the cover 22 and the front wall 34 in a manner to be described subsequently.

Figure 10:
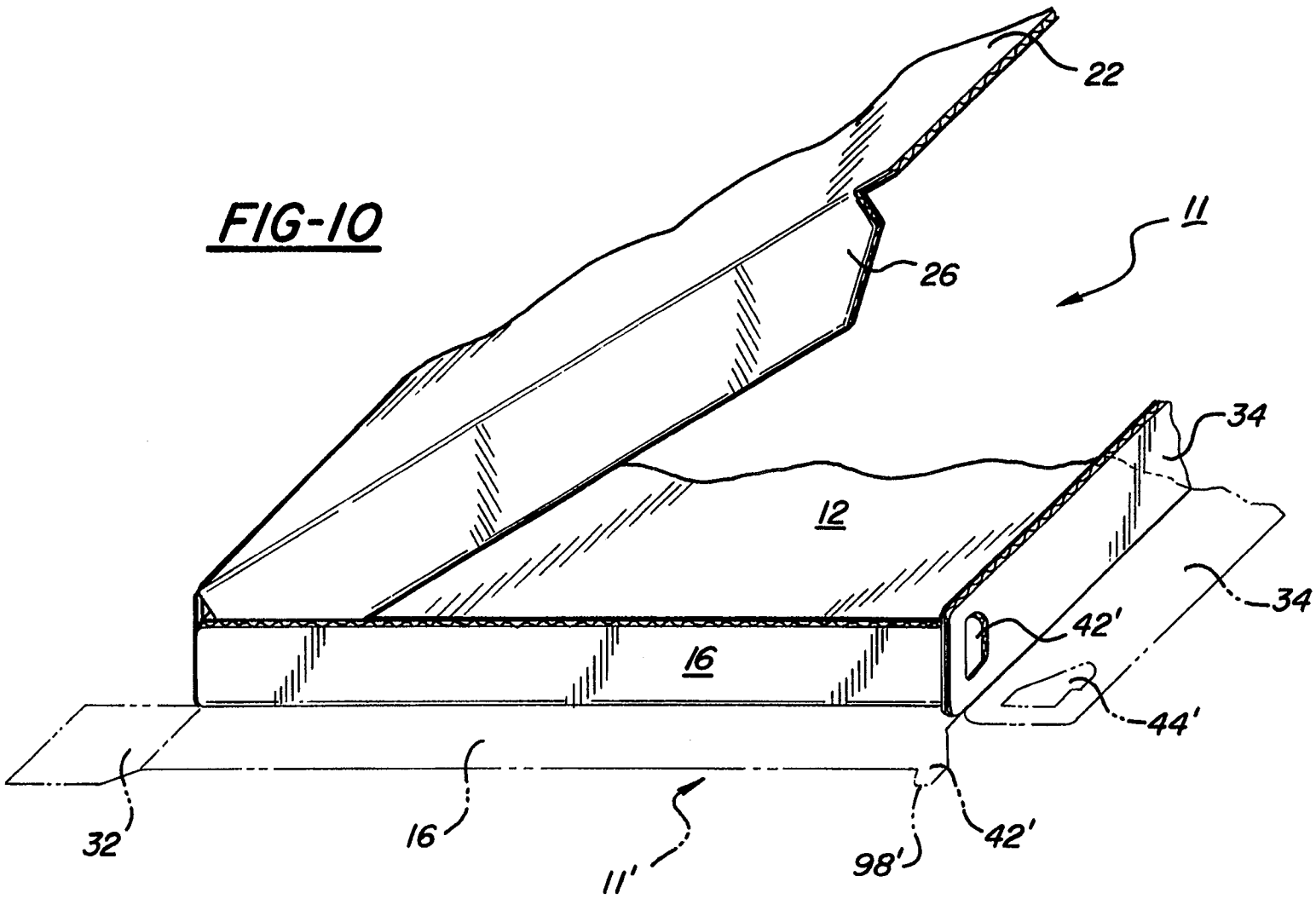
FIG. 10 shows a modification of the box of this invention.

A modification of the box 10 will now be described with reference to FIG. 10. The box 11 in its erect state, is shown in uninterrupted lines and the box blank 11' is shown in interrupted lines. In this modification, each of the side walls of the box is of uniform height throughout its length. The hook portion 98' of the tab 42' extends above the height of the side wall 16. Similarly, the side wall 14 (not shown in FIG. 10) is provided with a tab having a hook portion which extends above the height of the side wall. Otherwise, the box 11 is the same as box 10.

The board material from which the box is made preferably has a resilient property which causes the material to exhibit a spring-back movement when it is folded from a flat condition. Spring-back is exhibited when the box blank is folded from its flat condition to form a box by folding along the fold lines formed by scoring to provide hinge lines or elements in the material. In the flat condition of the box blank, the hinge elements are substantially unstressed. When the box is folded along a fold line from its flat condition, the hinge element is stressed. Spring-back is exhibited even after the material has been folded and unfolded several times. The spring-back force which is exerted after the first two or three folds is preferably strong enough to produce movement of the folded part after it is released even when there is a small amount of frictional resistance. This feature of the box is utilized in connection with setting up the box, as will be described presently.

The manner in which the box 10 is erected from the box blank 10' will now be described. The preferred technique of manual manipulation is set forth in the following description to achieve minimum set-up time and ease of handling. The procedure will be described in terms of instructions to a person performing the operation.

First, using both hands grasp the side walls 14 and 16 near the front corners and simultaneously fold the side walls to a position which makes an angle of about sixty or seventy degrees with the bottom panel 12 and hold them in that position. (See FIG. 4.) Then, using both thumbs fold the front wall 34 to an upright position with the tabs 42 and 42' extending through the respective openings 44 and 44'. (See FIG. 5.) Then release the side walls 14 and 16 thereby allowing them to spring back to the upright position. In this released condition, the front wall 34 springs back against the hook portions 98 and 98' which by frictional resistance increases the holding effort of the interlock to resist unwanted opening. As shown in FIG. 6, the front wall 34 is held in the upright position, approximately perpendicular to the base panel 12, by the tabs 42 and 42' with the edges of the notches 102 and 102' being in engagement with both sides of the shoulder portion 112 and 112', respectively. Also, each side wall 14 and 16 is held in upright position, i.e. substantially perpendicularly to the bottom panel 12, by engagement with the outer edges 104 and 104' of the openings 44 and 44' respectively Next, the corner flaps 28 and 32 are folded inwardly while holding the box with one hand on each side wall and pushing the corner flaps inwardly with the fore-finger and, in a continuing motion of the other fingers, the rear wall 18 is folded to an upright position. In a further continuing motion, the cover flaps 24 and 26 are folded inwardly by thumb action and, with the cover flaps held inwardly far enough to be inside the side walls 14 and 16, the cover is folded downwardly by pulling with the fore-fingers. Finally, the cover 22 is secured to the front wall 34 by pushing the center of the front wall inwardly until the tab 54 is aligned with the larger portion 122 of the opening 56 (see FIG. 7) allowing the tab to pass through the opening; then, the pressure on the front wall is released thereby allowing the front wall 34 to spring back with the tab 54 moving into the smaller portion 118 of the opening 56 with the edges of the notches 116 engaging both sides of the cover adjacent the smaller opening portion 118 (see FIG. 8). This interlocks the cover 22 and the front wall 34. The box is now closed and is in the condition shown in FIG. 2.

To open the box, the following procedure is used. First, using both hands grasp the side walls 14 and 16 near the front corners and with thumb pressure, push the front wall 34 slightly inwardly until the tab 54 is aligned with the larger portion 122 of the opening 56 and then raise the cover with the thumbs until it is free of the tab 54. To disconnect the corner interlocks 36 and 36' so the walls can be laid flat for cutting pizza inside the box, the following procedure is used. With the side walls 14 and 16 between the hands, apply inward pressure on the walls until the tabs 42 and 42' are in engagement with the edges 106 and 106' of the openings 44 and 44' so that the front wall 34 is free to spring forward, free of the tabs. The box may be re-erected by the procedure described above.

Figure 9:
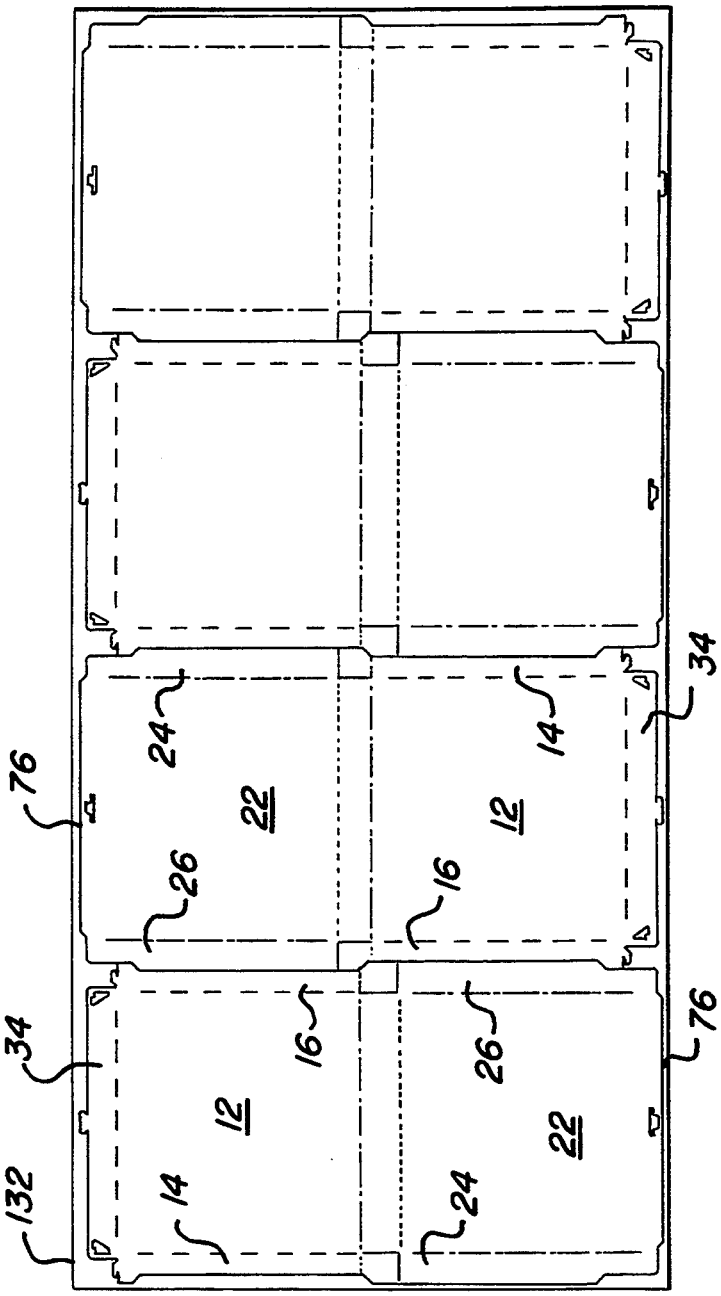
FIG. 9 is a plan view of plural box blanks as they would be cut sequentially from a strip of material.

The box blank 10' as shown in FIG. 1, is cut from a board 132 in FIG. 9. The board 132 is rectangular in shape and has one dimension which is substantially equal to the length of the blank 10' and its other dimension may range from that required for just two blanks 10' side-by-side to that required for a larger number of blanks side-by-side. As shown in FIG. 9, the board 132 has such dimensions that four blanks may be cut therefrom without substantial waste. In the terminology used herein, the "width" dimension of the board 132 is that dimension which is equal to that required for the length of the blank 10' and the "length" dimension is that dimension which will accommodate two or more blanks 10' side-by-side even though it may be smaller than the "width" dimension of board.

As shown in FIG. 9, four box blanks 10' are disposed side-by-side on the board 132. In order to minimize waste of board material, the box design, as described with reference to FIGS. 1 and 2, is such that the blanks 10' which are adjacent to each other are nested together by orienting them on the board 132 with orientations which are one hundred-eighty degrees apart, i.e. The free edge 76 of the leftmost blank 10' is at the bottom of the board 132 as viewed in FIG. 9 and the free edge 76 of the adjacent blank 10' is at the top. It is noted that the nesting arrangement of the adjacent box blanks 10' allows a contiguous relationship which extends from the front end of the side wall of one blank to the front end of the side wall of the adjacent blank so that the adjacent blanks may be cut apart by slitting the material throughout this length without any waste. The only waste between adjacent blanks is that material which is cut out between the front ends of the side walls and the edges of the board 132.

A box and box blank have been disclosed which are fabricated with a minimized amount of material from a flat board. The box is provided with a front corner interlock and a cover interlock which require a minimum of material and which provide structural integrity and a high degree of rigidity. The interlocks facilitate fast set-up time and take-down time of the box. The box can be used by pizzerias that cut the pizza in the box as well as those that cut it outside the box.

Although this invention has been described with reference to a particular embodiment, it is not to be construed in a limiting sense. Many variations and modifications will now occur to those skilled in the art. For a definition of the invention reference is made to the appended claims.

What is claimed is:

1. A box folded from a flat board and comprising:

a bottom having front and rear edges, first and second side walls hingedly attached along respective hinge lines to opposite side edges of the bottom, each of said side walls having front and rear ends, front and rear walls hingedly attached along respective hinge lines to the front and rear edges, respectively, of the bottom, each of said walls being flat and defining a plane, first and second tabs extending forwardly from the front end of the first and second side walls, respectively, each tab having a hook portion and being coplanar with its respective side wall, the front wall having first and second openings aligned, respectively, with the first and second tabs, the first opening having inner and outer edges and a first opening portion at a location which allows the first tab to pass through the front wall with the first tab substantially perpendicular to the front wall when the first side wall is in a first folded position and when the front wall is folded toward the front end of the first side wall to a predetermined position in which the plane of the front wall is between the hook portion of the first tab and the front end of the first side wall, said first opening having a second opening portion which allows the first side wall to be moved from the first folded position to a second folded position in which a portion of the front wall is disposed between the hook portion of the first tab and the front end of the first side wall when the front wall is in said predetermined position, the second opening having inner and outer edges and a first opening portion at a location which allows the second tab to pass through the front wall with the second tab substantially perpendicular to the front wall when the second side wall is in a first folded position and when the front wall is folded toward the front end of the second side wall to a predetermined position in which the plane of the front wall is between the hook portion of the second tab and the front end of the second side wall, said second opening having a second opening portion which allows the second side wall to be moved from the first folded position to a second folded position in which a portion of the front wall is disposed between the hook portion of the second tab and the front end of the second side wall when the front wall is in said predetermined position, whereby said side walls may be interlocked with said front wall by said tabs.

2. A box as defined in claim 1 wherein:

said hook portion of the first tab has an edge opposite the end of the first side wall forming a first notch which terminates in a close end, said hook portion and the end of the side wall define a notch.

3. A box as defined in claim 2 wherein:

the closed end of the first notch is in alignment with the hinge line of the front wall, the closed end of the second notch is in alignment with the hinge line of the front wall, whereby said front wall is positioned by the tab so that the front wall is approximately perpendicular to the bottom.

4. A box as defined in claim 1 wherein:

said first opening includes an outer edge in approximate alignment with the hinge line of the first side wall whereby the first side wall is retained in an interlocked position approximately perpendicular to the bottom, and said second opening includes an outer edge in approximate alignment with the hinge line of the second side wall whereby the second side wall is retained in an interlocked position approximately perpendicular to the bottom.

5. A box as defined in claim 2 wherein:

each of said notches have a width at the closed end which is equal to or less than the thickness of the front wall.

6. A box as defined in claim 1 wherein:

the inner edge of said first opening limits the movement of the first side wall to said first folded position by engagement of said tab, and the inner edge of said second opening limits the movement of the second side wall to said first folded position by engagement of said tab.

7. A box as defined in claim 6 wherein, said first folded position of each side wall is a position in which each side wall is folded inwardly to an angle of about seventy degrees from the bottom.

8. A box as defined in claim 1 wherein said second opening portion of the first and second openings is disposed outwardly, respectively, of said first opening portion of the first and second openings.

9. In a box of a type folded from a flat board and having a panel with first and second adjacent angularly oriented edges and having first and second walls attached to and folded at said first and second edges, respectively, to an approximately upright position from the panel, each of said walls being flat and defining a plane, the first wall having an end, a corner interlock comprising:

a tab having a hook portion extending from the end of the first wall, said tab being coplanar with the first wall, the second wall having an opening including a first opening portion at a location which allows the tab to pass through the second wall with the tab substantially perpendicular to the second wall when the first wall is in a first folded position and when the second wall is folded toward the end of the first wall to a predetermined position in which the plane of the second wall is between the hook portion and the end of the first wall, said opening including a second opening portion which allows the first wall to be moved from the first folded position to a second folded position in which a portion of the second wall is disposed between the hook portion and an edge of the first wall when the second wall is in said predetermined position whereby the first wall is interlocked with the second wall by said tab.

10. A box as defined in claim 9 wherein:

said hook portion and the end of the first wall define a notch.

11. First and second blanks for folding into first and second boxes, respectively, each of said blanks comprising:

a bottom panel having front, rear, right side and left side edges defined by corresponding fold lines on said blank, right and left side walls attached to the bottom panel along said right side and left side fold lines, respectively, and having front and rear edges, a front wall having front and rear edges with its rear edge attached to the front edge of said bottom panel along said front fold line, a rear wall having a lower and an upper edge, the lower edge being attached to the rear edge of the bottom panel along the rear fold line, a cover having rear, right side and left side edges defined by corresponding fold lines on said blank, said rear edge of the cover being attached to the upper edge of the rear wall, right and left side flaps attached to the right and left edges, respectively, of said cover along the corresponding right side and left side fold lines, each of the right and left side flaps having a height throughout a first part of its length which is substantially the same as the height of the rear wall, each of the right and left side walls having a height throughout a first part of its length which is smaller than the height of the rear wall, said first and second blanks being disposed side-by-side and oriented at one hundred-eighty degrees from each other with at least a portion of said first part of one of the right and left side flaps being nested in at least a portion of said first part of the same one of the right and left side walls.

12. First and second blanks as defined in claim 11 wherein:

each of the right and left side flaps of each blank has a height throughout a second part of its length which is less than the height of the rear wall by an offset distance, and said height of each of the right and left side walls throughout the first part of its length is smaller by substantially said offset distance than the height of the rear wall and the height throughout a second part of its length is substantially the same as the height of the rear wall.

13. First and second blanks as defined in claim 11 wherein:

said first part of the length of each side flap is more than half the length of the side flap, and said first part of the length of each side wall is more than half the length of the side wall.

14. First and second blanks as defined in claim 11 wherein, in each of said blanks, the rear edge of the bottom panel is approximately half-way between the front edge of the cover and the front edge of the front wall.

15. First and second blanks formed on a single board and cut apart for folding into separate boxes, each of said blanks comprising:

a bottom panel having front, rear, right side and left side edges defined by corresponding fold lines on said blank, right and left side walls attached to the bottom panel along said right side and left side fold lines, respectively, a front wall attached to the front edge of said bottom panel along said front fold line, a rear wall having a lower and an upper edge, the lower edge being attached to the rear edge of the bottom panel along the rear fold line, a cover having rear, right side and left side edges defined by corresponding fold lines on said blank, said rear edge of the cover being attached to the upper edge of the rear wall, right and left side flaps attached to the right and left edges, respectively, of said cover along the corresponding right side and left side fold lines, each of the right and left side flaps having a height throughout at least part of its length which is substantially the same as the height of the rear wall, each of the right and left side walls having a height throughout at least part of its length which is smaller than the height of the rear wall, said first and second blanks being oriented at one hundred eighty degrees from each other and nested in contiguous relationship.

16. In a box of a type folded from a flat board and having a panel with first and second adjacent angularly oriented edges and having first and second walls attached to and folded along said first and second edges, respectively, each of said walls being flat and defining a plane the first wall having an end, the first and second walls being attached to the panel by first and second hinge elements for folding of the walls along said edges, each of the hinge elements being sufficiently resilient to exhibit spring-back movement from a stressed position toward an unstressed position, said hinge elements being unstressed when the walls and panel are flat, a corner interlock comprising:

an interlock tab extending from the end of the first wall, said tab being coplanar with the first wall, the second wall having an opening with a periphery at a location which allows the tab to pass through the opening with the walls folded towards an approximately upright position relative to the panel to make a corner and with the tab and opening in a first relative position, said tab being engageable with the periphery of said opening to interlock the walls with the tab and opening in a second relative position, said walls being urged by the spring-back of said hinge elements from the first to the second relative position.

17. A box as defined in claim 16 wherein:

the tab has a hook portion, said hook portion being in opposed relation to the second wall when the tab and opening are in the second relative position, said hook portion being urged into engagement with the second wall by spring-back of the second wall.

18. A box as defined in claim 17 wherein:

said hook portion and the end of the first wall define a notch whereby the second wall is held between the hook portion and the end of the first wall when the tab and opening are in the second relative position.

19. A box as defined in claim 17 wherein:

the panel is the bottom of the box, and the hook portion extends upwardly from the panel.

20. A box as defined in claim 18 wherein:

the panel is the bottom of the box, and said notch opens upwardly from the tab.

* * * * *